United States Patent [19]

McGlothlan

[11] Patent Number: 4,767,964

[45] Date of Patent: Aug. 30, 1988

[54] IMPROVED MESH FOR CRT SCAN EXPANSION LENS AND LENS FABRICATED THEREFROM

[75] Inventor: J. Kirk McGlothlan, Beaverton, Oreg.

[73] Assignee: Tektronix, Inc., Beaverton, Oreg.

[21] Appl. No.: 11,082

[22] Filed: Feb. 4, 1987

[51] Int. Cl.[4] ..... H01J 3/26; H01J 29/70

[52] U.S. Cl. ..... 313/421; 313/293; 313/295; 313/349

[58] Field of Search ..... 313/421, 295, 348, 349, 313/293

[56] References Cited

U.S. PATENT DOCUMENTS 2,619,438 11/1952 Varian et al. ..... 313/349 X 3,240,972 3/1966 Law ..... 313/348

*Primary Examiner*—Leo H. Boudreau

*Assistant Examiner*—K. Wieder

*Attorney, Agent, or Firm*—John D. Winkelman; Paul S. Angello

[57] ABSTRACT

An improved mesh lens for PDA-type cathode-ray tubes is constructed in a manner that permits deformation into a concavo-convex shape with a substantially shorter radius of curvature than heretofore obtainable with prior art devices. A mesh lens (12) formed in accordance with this invention particularly comprises of multitude of interconnected webs (58) forming an array of apertures (60). Each web (58) has opposing ends and a midline (62) extending between those ends. The mesh (12) is configured so that an individual aperture (60) of the array is formed by a set of webs (58) interconnected at their ends. The midline (62) of each web in the undeformed mesh defines a bent line. The mesh can be deformed into a concavo-convex shape having a relatively short radius of curvature. This is so because the individual webs of the mesh respond to the application of deformation forces by initially straightening, thereby effectively delaying the development of tensile stresses in the webs.

9 Claims, 1 Drawing Sheet

IMPROVED MESH FOR CRT SCAN EXPANSION LENS AND LENS FABRICATED THEREFROM

BACKGROUND OF THE INVENTION

The present invention relates generally to electrostatic scan expansion lens systems for cathode-ray tubes, and more particularly to an improved mesh-type scan expansion lens for such tubes.

Cathode-ray tubes (CRT's) include an evacuated envelope comprising a tubular neck and a generally frustum-shaped funnel portion that is contiguous with one end of the neck and diverges outwardly therefrom. The outer end of the funnel portion is sealed against a face plate that carries a phosphorescent display screen.

An electron gun is positioned within the neck at the end opposite the funnel portion. The electron gun produces a beam of electrons that passes through the neck and funnel portion and illuminates a spot on the phosphorescent display screen. The beam also passes between two pairs of electrostatically charged deflection plates that are located in the neck between the electron gun and the display screen. The direction of the beam is deflected (hence, the position of the spot on the screen is changed) whenever a deflection voltage is applied to at least one of the pairs of deflection plates. The deflection voltage is continuously altered to deflect the beam so that, for example, a particular waveform is illuminated on the display screen. The amount of deflection of the beam for a given deflection voltage is known as deflection sensitivity. To increase the deflection sensitivity of a CRT is to increase the beam deflection without increasing the deflection voltage applied across the deflection plates.

The brightness of the spot illuminated on the display screen by the beam is characterized as the display luminance. The display luminance is increased by increasing the velocity of the beam, which is accomplished by increasing the beam accelerating voltage.

It is often desirable to construct a CRT with high display luminance and high deflection sensitivity. However, with conventional CRT designs, these performance goals usually conflict. Specifically, if the beam accelerating voltage is increased to raise the velocity of the beam before the beam passes the deflection plates, the deflection sensitivity of the beam decreases. That is, the beam is stiffer more resistant to deflection. This is so because deflection sensitivity is inversely proportional to the accelerating voltage. This conflict traditionally has been resolved by deflecting the beam in a region of low potential, then increasing the beam velocity by means of a high-voltage field after the beam exits the deflection region. This technique is commonly known as post-deflection acceleration, or PDA.

One type of PDA CRT creates the high-voltage field by placing an anode within the funnel portion of the CRT. Specifically, the anode comprises an electron-transparent conductive target layer overlying the display screen and an electrically connected continuous conductive film applied to the interior surface of the funnel portion. The electric field resulting from the presence of such an anode has increasing potential in the direction of beam travel and is, therefore, effective in accelerating the beam and increasing the display luminance. To enhance the deflection sensitivity of the CRT while simultaneously preventing penetration of the high-voltage field into the low-voltage deflection region, a field-forming mesh electrode is positioned within the tube between the deflection plates and the anode. The mesh comprises a multitude of interconnected webs forming an array of apertures. When incorporated into the CRT, the mesh has a concavo-convex configuration and is positioned with its convex surface facing the display screen. As a result, the equipotential surfaces of the high-voltage field generally conform to the convex shape of the mesh electrode. Since the forces created by the high-voltage field direct the electron beam to pass in a direction that is normal to the equipotential surfaces, the above-described force field created by the anode and mesh combination represents that of a diverging electron lens. That is, a beam passing through this field tends to diverge from the central longitudinal axis of the CRT. Accordingly, the beam divergence produced by this electron lens increases the deflection sensitivity of the CRT.

If the radius of curvature of the mesh electrode is reduced, the resulting curvature of the equipotential surfaces of the high-voltage field will cause correspondingly greater divergence of the beam. It can be readily appreciated that to achieve high deflection sensitivity, it is desirable to produce a mesh that is deformable into a concavo-convex shape having as short a radius of curvature as possible.

A mesh is typically formed by electrodeposition of metal (for example, nickel) onto a planar mandrel. The resulting planar mesh is then annealed. The concavo-convex shape is achieved by deforming the mesh within a curved mold. In the past, the mesh could be deformed by only a limited amount because too much deformation resulted in breakage of the fragile metal webs. Breakage results from tensile stresses that develop over the entire cross section of each web when the mesh is deformed. Metal, such as nickel, will strain (i.e., stretch) somewhat in response to the tensile stress but quickly reaches its tensile strength limit and breaks. As a consequence, the limited amount of curvature that could be formed into the mesh correspondingly limited the deflection sensitivity of the CRT into which the mesh was incorporated.

SUMMARY OF THE INVENTION

This invention is directed to an improved mesh-type electron lens element that is constructed in a manner that permits deformation into a concavo-convex shape with a substantially shorter radius of curvature than heretofore obtainable with prior art devices.

A mesh formed in accordance with this invention comprises a multitude of interconnected webs forming an array of apertures. Each web has opposing ends and a midline extending between those ends, the midline defining a line that extends along the length of and bisects the web. The mesh is configured so that each aperture of the array is formed by a set of webs interconnected at their ends. Each web is bent such that the midline of each web in the set defines a bent line, e.g., a curved line or a line with a sharp corner.

A mesh formed as just described can be deformed into a concavo-convex shape having a relatively short radius of curvature. This is so because the individual bent webs of the mesh respond to the application of deformation forces initially by straightening, thereby effectively delaying the development of tensile stresses that tend to break the web.

A mesh formed in accordance with this invention, once deformed and incorporated into a CRT, creates an electron lens that has high beam deflection sensitivity.

DETAILED DESCRIPTION OF A PREFERRED EMBODIMENT

Figure 1:
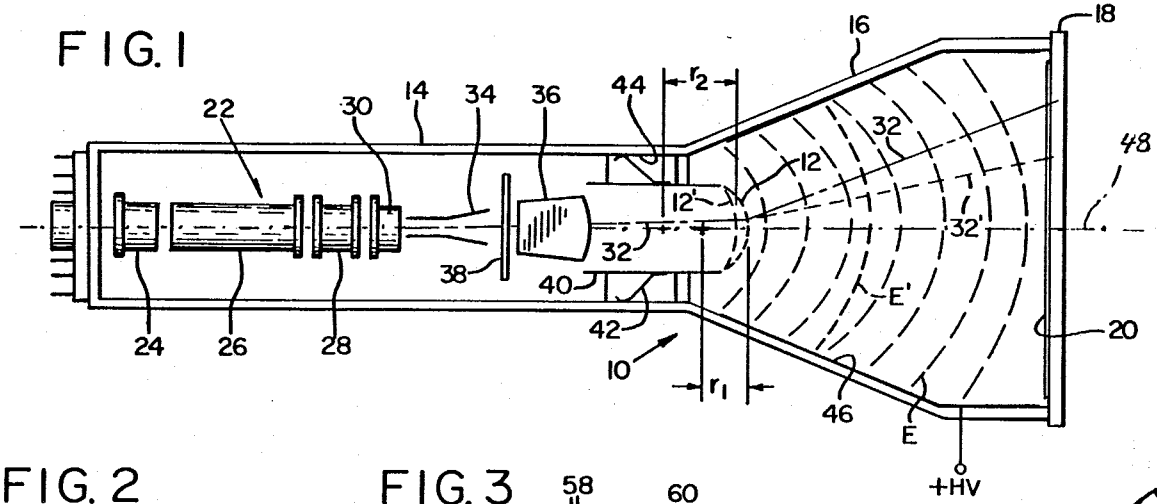
FIG. 1 is a schematic longitudinal section view of a cathode-ray tube incorporating a mesh PDA scan expansion lens formed in accordance with this invention.

A PDA-type CRT 10 incorporating a curved or dome-shaped mesh scan expansion lens 12 formed in accordance with this invention is shown in FIG. 1. The CRT 10 includes an evacuated envelope comprising a tubular glass neck 14 with a generally frustum-shaped ceramic funnel portion 16 attached to one end of the neck. The outer end of the funnel portion is sealed against a transparent glass face plate 18, which carries a phosphorescent display screen 20. An electron gun 22 is mounted within the neck at the end opposite the funnel portion 16. The electron gun is of conventional design, including a cathode and control grid unit 24, a first anode 26, a focus electrode 28 and a second anode 30. The gun produces an electron beam 32 that passes through the neck 14 and funnel portion 16 to illuminate a spot on the phosphorescent display screen.

Prior to striking the display screen 20, the beam passes between adjacent pairs of vertical deflection plates 34 and horizontal deflection plates 36, respectively. The vertical and horizontal deflection plates are separated by a shield electrode 38. The beam passes through a cylindrical metal tube 40 that is positioned between the horizontal deflection plates 36 and the display screen 20. The end of tube 40 nearer the display screen carries the metal mesh electrode 12 of the present invention. The mesh 12 is of concavo-convex shape, and positioned with the convex side of the mesh electrode facing the display screen. The mesh is electrically connected through tube 40 and spring contacts 42 to a conductive band 44 that lines the inside surface of the neck adjacent to the funnel portion 16. Band 44 is maintained at the approximate mean potential of horizontal deflection plates 36, typically at or near ground potential, thereby establishing an essentially field-free region between electrode 12 and the outer ends of the horizontal deflection plates 36.

A high-voltage field present between the mesh electrode 12 and the display screen 20 accelerates the beam after it exits the deflection region. The high voltage field is created by constructing an anode within the funnel portion 16 of the tube. More particularly, a thin electron-transparent aluminum target layer (not shown) is mounted to overlie display screen 20. The target layer is electrically connected to a conductive coating 46 that covers the inner surface of funnel portion 16. Coating 46, which is connected in a known manner to an external high-voltage source at +HV (typically in the range of about 13–20 KV), terminates near the outer perimeter of mesh 12 as shown in FIG. 1. The strong electrostatic field created within the funnel portion 16 accelerates the electrons of the beam 32 as they exit the curved mesh electrode.

The mesh electrode 12 imparts within the funnel portion a field curvature that corresponds to the shape of the mesh. This field is represented by a family of equipotential surfaces E in FIG. 1. The shape of the equipotential surfaces creates an electron lens that magnifies the beam deflection imparted by the deflection plates. This increase in beam deflection occurs in the absence of a corresponding increase in deflection voltage. Thus, the curved mesh electrode 12 increases the deflection sensitivity of the CRT.

It is apparent that the amount of beam deflection that occurs after the beam exits the deflection region depends to a great extent on the shape of the curved mesh or, more particularly, the shape of the electrostatic field formed by the mesh. Thus, for a curved mesh with a radius of curvature $r_1$ (FIG. 1), the radii of curvature of the equipotential surfaces E will generally correspond to radius of curvature $r_1$. However, if the mesh is constructed so that it can be deformed to have a radius of curvature that is relatively longer than the first-mentioned radius of curvature $r_1$, the resulting equipotential surfaces will be correspondingly flatter. Such an alternatively shaped mesh is shown as 12' in FIG. 1. Also illustrated is a single representative equipotential surface E' resulting from the alternatively shaped mesh. It is clear that the electrostatic field conforming to the flatter (i.e., longer radius of curvature) mesh 12' will result in relatively less deflection in the beam (illustrated as 32' in FIG. 1) compared to deflection achieved with a mesh electrode 12 having a relatively shorter radius of curvature.

It is noteworthy that the mesh need not have a constant radius of curvature over the entire concave surface. The mesh may be formed into a curve having radii of curvature changing over the concave surface (e.g., a parabolic curve). In any event, the radii of curvature referred to herein are as measured along the central longitudinal or beam axis 48 of the CRT, since that axis is typically coincident with the shortest radius of curvature of the mesh.

Figure 2:
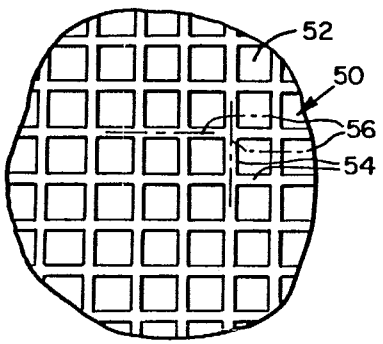
FIG. 2 (PRIOR ART)
FIG. 2 is a greatly enlarged plan view showing a portion of a conventional rectangular shaped mesh.

FIG. 2 shows, greatly enlarged, a portion of a prior art mesh 50 having square apertures 52 arranged in a repeating row/column pattern. The apertures 52 are defined by interconnected webs 54. A domed mesh of this type, designed for a modern, 100 MHz oscilloscope CRT, may have a thickness of 8 to 10 microns and a pitch of about 295 lines/cm (750 lines per inch). The webs 54 of the mesh are approximately seven microns wide. The mesh is formed by electrodeposition of a metal, such as nickel, onto a planar mandrel. The mesh is then annealed. The planar mesh is then deformed into a smooth curve. This deformation is typically accomplished by securing the edge of the mesh and then forcing the central portion of the mesh into a concave mold. It is the planar version of a prior art mesh 50 that is depicted in FIG. 2. As shown in FIG. 2, the central axis or midline 56 of each web 54 defines a straight line. When the mesh is forced out of the planar shape and into the curved mold, tensile stresses immediately develop over the cross section of each web. To achieve the shortest possible radius of curvature in the mesh, the mold is designed so that the mesh will be deformed as much as possible without exceeding the tensile strength of the webs.

Figure 3:
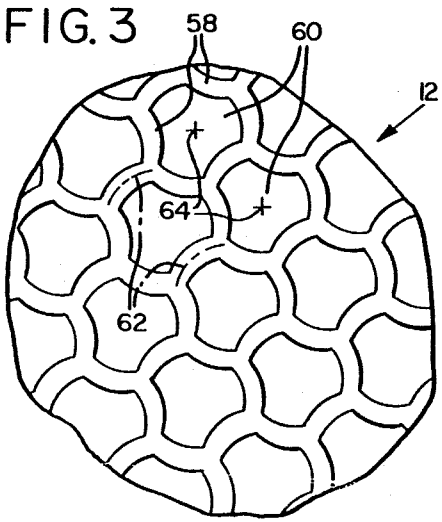
FIG. 3 is a greatly enlarged plan view showing a portion of a mesh lens formed in accordance with this invention prior to deformation into a concavo-convex shape.

The mesh of the present invention is configured so that when deformed, the development of tensile stresses tending to break the webs is delayed, thereby permitting a greater amount of deformation than would otherwise be possible. Specifically, with reference to FIG. 3, the mesh 12 comprises a multitude of interconnected webs 58 forming an array of apertures 60. Each aperture 60 is defined by a set of webs 58 that are interconnected at their ends. The mesh 12 is formed by a conventional electrodeposition process. Mesh 12 may have a thickness of 8 to 9.5 microns and a predeformation pitch of about 325 lines/cm (830 lines per inch). The webs 58 of the mesh are about 8 to 12 microns wide. Each of the webs 58 is bent such that the midline 62 of each web defines a bent line, e.g., a curved line or a line with a sharp corner. Each midline 62 defines a line that extends along the length of and bisects a web 58. In the preferred embodiment, the webs 58 are formed so that every other web in an even-numbered set of webs (e.g., six webs) defining a single aperture 60 is bent outwardly from the center 64 of the aperture. The intervening webs are bent inwardly toward the center 64 of the aperture. This scheme results in a regular array of substantially identically shaped apertures. The centers 64 are spaced apart by 30–52 microns. It is contemplated that the webs can be bent in any uniform or random fashion (for example, zigzag) as long as the midlines of the webs are bent, that is, not straight. In one exemplary embodiment, each of the webs 58 has a bend (e.g., a sharp corner) and a length that provides an array of apertures 60 having between the centers 64 a distance of 30 microns before deformation and a distance of 33 microns after deformation. For instance, webs shaped to define an array of circular apertures would not be suitable, since the midlines of those webs are essentially straight.

When a mesh formed in accordance with this invention is deformed from a planar to a curved shape, the deformation forces initially straighten the bent webs. The straightening of the webs effectively delays the development of tensile stresses acting over the cross section of each web that would otherwise tend to break the webs apart. Accordingly, the mesh is deformable into a concavo-convex shape having a relatively short radius of curvature before the tensile strength of the metal mesh is reached.

Figure 4:
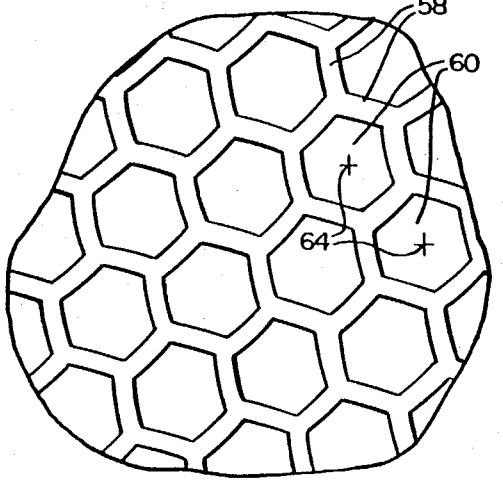
FIG. 4 is a greatly enlarged plan view of a portion of a mesh lens formed in accordance with this invention after deformation into a concavo-convex shape.

FIG. 4 depicts the resulting configuration of the mesh 12 of FIG. 2 after deformation into a concavo-convex shape. The webs 58 are deformed until they are substantially straight. Further, the shape of each aperture 60 after deformation is substantially hexagonal. This shape is a consequence of the predeformed configuration of the mesh 12 shown in FIG. 3. A mesh formed in accordance with the present invention can have a radius of curvature of about 0.825 cm, which is about 46.4% less than that achievable with a prior art mesh with webs whose midlines are essentially straight.

While a preferred embodiment of this invention has been illustrated and described, it will be appreciated that various changes can be made therein without departing from the spirit and scope of the invention. For instance, it is not necessary that every web of the mesh be configured to have a midline that defines a bent line. A few webs, such as those near the edge of the mesh, may have straight midlines without substantially affecting the deformation of the mesh.

I claim:

1. A deformable mesh for fabricating a scan expansion mesh lens for use in an electron discharge tube, said mesh comprising a multitude of interconnected webs forming an array of apertures, each web having opposing ends and a midline extending between the ends, the mesh being configured so that each aperture of the array is formed by a set of webs interconnected at their ends, and the mesh being further configured so that, in its undeformed state, the midlines of at least some of the interconnected webs define bent lines.

2. The mesh of claim 1, wherein each set of webs is comprised of an even number of webs; and wherein every other web in the set is bent outwardly from the center of the aperture defined by that set, and wherein each web interconnected between each said every other web is bent inwardly toward the center of the aperture defined by that set.

3. The mesh of claim 2, wherein each set of webs comprises six webs that are configured so that when deformed into a concavo-convex shape the aperture defined by each deformed set of webs is substantially hexagonal.

4. The mesh of claim 1, wherein the mesh is formed of electrically conductive material.

5. A deformable mesh for fabricating a scan expansion mesh lens for a cathode-ray tube, comprising in its undeformed state a multitude of electrically conductive interconnected webs forming an array of apertures, each web having opposing ends and a midline extending between the ends, the mesh being configured so that each aperture of the array is formed by a set of webs interconnected at their ends, the midlines of at least some of the interconnected webs defining bent lines.

6. The mesh of claim 5, wherein the mesh is configured os that when deformed into a concavo-convex shape, the resulting apertures of the mesh have a substantially hexagonal shape.

7. A method of fabricating a mesh scan expansion lens, comprising the steps of providing a substantially flat mesh having in its undeformed state a multitude of electrically conductive interconnected webs, at least some of which have bent midlines, the interconnected webs defining an array of apertures, and deforming said mesh into a concavo-convex shape.

8. The method of claim 7 in which the flat mesh is formed by electrodepositing lines of metallic material onto a planar mandrel.

9. A cathode-ray tube, comprising:

electron gun means positioned at one end of the tube for producing a beam of electrons directed along a beam axis in the tube;

deflection means for deflecting the electron beam; and post-deflection acceleration means positioned adjacent the deflection means along the beam axis for accelerating the electron beam, the post-deflection acceleration means including an electrically conductive mesh lens secured within the tube, said mesh lens being formed by providing a substantially flat mesh having in its undeformed state a multitude of electrically conductive interconnected webs, at least some of which have bent midlines, the interconnected webs defining an array of apertures, and deforming said mesh into a concavo-convex shape.

* * * * *